United States Patent [19]

Kubelka et al.

[11] 4,125,274

[45] Nov. 14, 1978

[54] SAFETY SKI BINDING AND SKI BOOT COMBINATION

[75] Inventors: Axel R. Kubelka, Vienna; Josef Svoboda, Schwechat, both of Austria

[73] Assignee: Gertsch AG, Zug, Switzerland

[21] Appl. No.: 824,142

[22] Filed: Aug. 12, 1977

Related U.S. Application Data

[63] Continuation of Ser. No. 641,376, Dec. 16, 1975, abandoned.

[30] Foreign Application Priority Data

Dec. 19, 1974 [AT] Austria ..... 10131/74

[51] Int. Cl.[2] ..... A63C 9/086

[52] U.S. Cl. ..... 280/618; 36/117; 280/611

[58] Field of Search ..... 280/618, 614, 620, 624, 280/626; 36/107, 117, 118, 119, 120, 121

[56] References Cited

U.S. PATENT DOCUMENTS

| | | | |
|---|---|---|---|
| 3,239,952 | 3/1966 | Lange et al. | 36/120 |
| 3,363,342 | 1/1968 | Stohr | 36/117 |
| 3,492,014 | 1/1970 | Von Besser | 280/618 |
| 3,675,938 | 7/1972 | Sigl | 280/636 |
| 3,806,144 | 4/1974 | Yans et al. | 280/636 |
| 3,854,743 | 12/1974 | Hansen | 280/618 |
| 3,876,218 | 4/1975 | Von Besser | 280/618 |
| 3,955,825 | 5/1976 | Kubelka et al. | 280/618 |

FOREIGN PATENT DOCUMENTS

| | | | |
|---|---|---|---|
| 1,801,920 | 10/1968 | Fed. Rep. of Germany | 36/119 |
| 2,016,988 | 9/1970 | Fed. Rep. of Germany | 280/624 |
| 1,785,151 | 7/1971 | Fed. Rep. of Germany | 36/117 |
| 212,583 | 3/1941 | Switzerland | 280/636 |

*Primary Examiner*—David M. Mitchell

*Attorney, Agent, or Firm*—Blanchard, Flynn, Thiel, Boutell & Tanis

[57] ABSTRACT

In a type of safety ski binding having if desired a plate fixed to the boot and releasably fixed to a ski, there is provided structure for lightening the boot construction, particularly the sole thereof, including the provision of structure for gripping the heel of the boot for holding same against such plate. Such structures extend around the heel a distance at least equal to one-third of the radius of the boot sole measured from and extending rearwardly from points on the sides of the ski boot where a plane perpendicular to the longitudinally central plane of the ski boot and containing the center point of the radius intersects the side walls of the ski boot. Reinforcement of the heel of the ski boot may be provided by utilizing a trough-shaped insert around the bottom of the boot which may, if desired, be interrupted at the ball of the foot for facilitating walking. Thin tension straps extend under the sole of the boot for reinforcing same and preventing slippage.

13 Claims, 6 Drawing Figures

Fig. 3
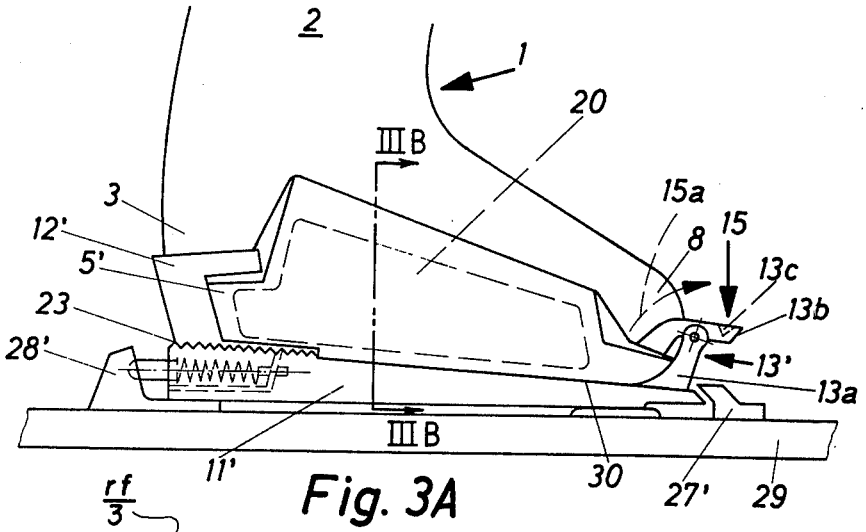
Fig. 3A
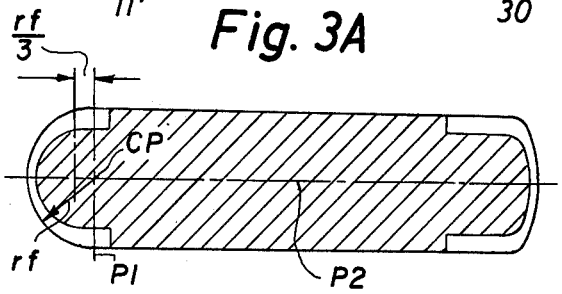
Fig. 4
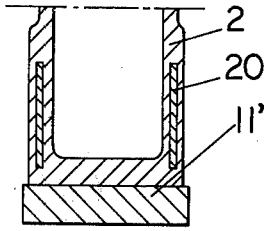
FIG.3B
Fig. 4A
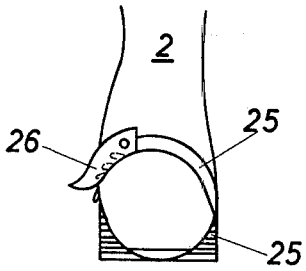
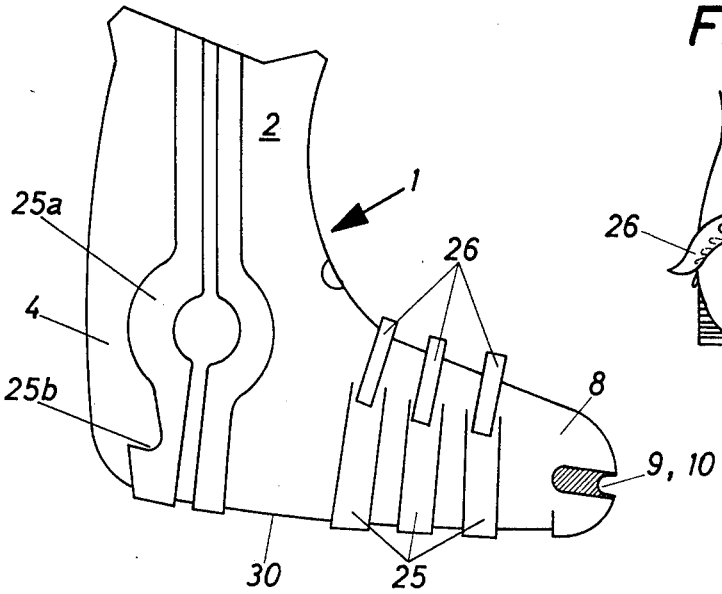

SAFETY SKI BINDING AND SKI BOOT COMBINATION

This is a continuation of application Ser. No. 641,376, filed Dec. 16, 1975.

FIELD OF THE INVENTION

The invention relates to a safety ski binding for use with a ski boot having a flexible sole comprising a sole rigidifying release plate which can be connected to the ski boot and is releasably secured on the ski. Holding elements for the ski boot are arranged on the release plate and receiving means for both holding elements are arranged on the ski boot. The release plate and/or ski boot may have additional mounting means for reinforcement if desired.

BACKGROUND OF THE INVENTION

A binding system between boot and ski in nonautomatically releasing ski bindings has been known for a long time. Such constructions have rigid binding parts in the tip zone of the ski boot, which hold the ski boot as firmly as possible on the ski, wherein the holding element for the heel fixes same in the longitudinal direction but permits a rotation of the heel about the longitudinal axis of the foot or the ski. This is among others a disadvantage of the common (nonautomatically releasing) ski bindings because the holding of the ski boot on the ski is dependent upon the construction of the boot sole.

In safety ski bindings which hold the boot directly on the ski, a ski boot with a rigid sole must be used because the release operations can be assured only in this manner. In safety ski bindings having a release plate, the accomplishment of the release is left to the plate so that here the use of a stiff ski boot — under certain conditions — is not a prerequisite. Also in this field various solutions are already known.

A safety ski binding of this type is approximately described in Swiss Pat. No. 505,630. In this known ski binding, there is provided as an additional mounting for the heel area a reinforcing member which is pivotal about an axis positioned transversely with respect to the longitudinal direction of the release plate, which reinforcing member is supported on the ski boot instep with stiff side portions and lends a lateral support to the instep part of the ski boot.

This known construction is not suited to address the entire problem, much less to solve it, which problem exists in working out a complete boot-ski-binding system. In order to consider the problems which occur herein, a brief consideration of the entire problem is needed, which problem of course is composed of diverse individual problems — the solution of which separately, however, does not result in a satisfactory solution for the entire problem.

Attempts are known to make the ski boot soles thin in order to save weight and to make the boot sole flexible and thus make it easier for the wearer to walk.

At the same time bindings are known which have, for example, thick plates which, used with normally soled ski boots, have an actual standing height which is approximately 6 to 8 cm.

While a thin sole can contribute to a secure edge feel, a disadvantage is created because the boot now projects over the sides of the ski and touches the snow during skiing, especially during edging. A high or thick boot sole mounted on a base plate prevents the latter but it changes the edge feel by increasing the incident moment, or rather the moment to be overcome, which cannot take place unlimitedly without requiring a reeducation of the skier.

Plate bindings have recently become known which carry parts of the closing mechanics, the safety strap, the quick adjustment, etc., and are distinguished by a special thickness. This increase in height is not desired by skiers because it is said to result in an unfamiliar edge feel. Also such devices involve a weight increase, contrary to the trend toward lightweight construction.

SUMMARY OF THE INVENTION

The purpose of the present invention is, independent from the structural height of the binding part and the thickness of the boot sole, to maintain the previously utilized standing height determined by the average sole thickness, to create in the field of the safety ski bindings a new combination of binding and boot and to make available a number of advantages, as for example improved skiing characteristics along with good walking capability and increased safety.

These objectives are attained according to the invention by constructing the receiving means in the rear zone of the ski boot laterally in pair and by the rear holding element gripping around the boot over the sole radii, up to approximately ⅓ of the same, and thus forming a mounting reinforcing the ski boot at the release plate.

The inventive construction of the safety ski binding assures the safe holding of a ski boot with soft sole just as much as in the case with stiff ski boots but without the disadvantages of stiff ski boots mentioned above. In particular, a more advantageous structural height is made possible, the weight of the new ski-boot-ski-binding system is reduced and the walkability of the ski boot is improved. The latter also guarantees additional comfort.

A specially advantageous embodiment of the inventive safety ski binding is seen in the additional mounting being formed as a reinforcing member which, in the clamped-in condition of the boot engages in the lower portion of the rear boot instep portion, substantially positively adjusted to same, and by the receiving means having a trough, groove or the like at the heel, into which engage locking pins or the like which form a transversely positioned axis, and by the receiving means of the tip of the boot having similar troughs, grooves or the like and/or reinforcements, into which engages the front holding element of the ski binding.

A further advantageous embodiment of the invention is found in the support surface of the binding for the ski boot having an inclination forwardly of approximately 3° to 6°. This improves the position of the foot for walking.

A still different embodiment is characterized by the receiving means of the ski boot having conventional notches, projections, metal fittings or the like, which are mounted directly on the side of the boot instep portion. This can improve the secure holding of the ski boot on the ski.

In a further embodiment it is possible to provide in the boot at least one insert to reinforce the holding zone and/or to prevent undesired bending actions.

A further development of this inventive thought consists in the insert being formed by a troughlike reinforcement which is injected into union with the lower part of the boot. A further characteristic is found in the front part of the insert projecting out of the boot and being constructed as a claw. According to a still further characteristic it is possible to provide the claw at the front part of the insert with a protective cover or flap at the upper side.

These measures increase the safety of the ski boot both in use for skiing and also for mountain climbing.

A different inventive thought consists in providing transverse reinforcements for the boot which receives at least one of the holding elements. This increases the unitary relationship of the boot and ski binding into one system. In a further development of this measure, it is also possible for the transverse reinforcements to grip under parts of the sole and thus serve as anti-skid means.

Finally, the surface of the sole can have an anti-skid design and the surface of the ski binding can be equipped with a design corresponding to said design.

BRIEF DESCRIPTION OF THE DRAWINGS

Further advantages and features of the invention will be described more in detail in connection with the drawings, which show some exemplary embodiments.

In the drawings:

FIG. 3 is a side view of the inventive safety ski binding with the ski boot inserted.

FIG. 3*a* illustrates in a top view the arrangement of the holding zones of FIG. 1.

FIG. 3*b* is a section taken on the line III*b*—III*b* of FIG. 3.

FIGS. 4 and 4*a* illustrate a ski boot which has transverse reinforcements, the safety ski binding being omitted.

FIGS. 5*a* and 5*b* are sections taken respectively on the line V*a*—V*a* and V*b*—V*b* of FIG. 5.

DETAILED DESCRIPTION

Figure 1:
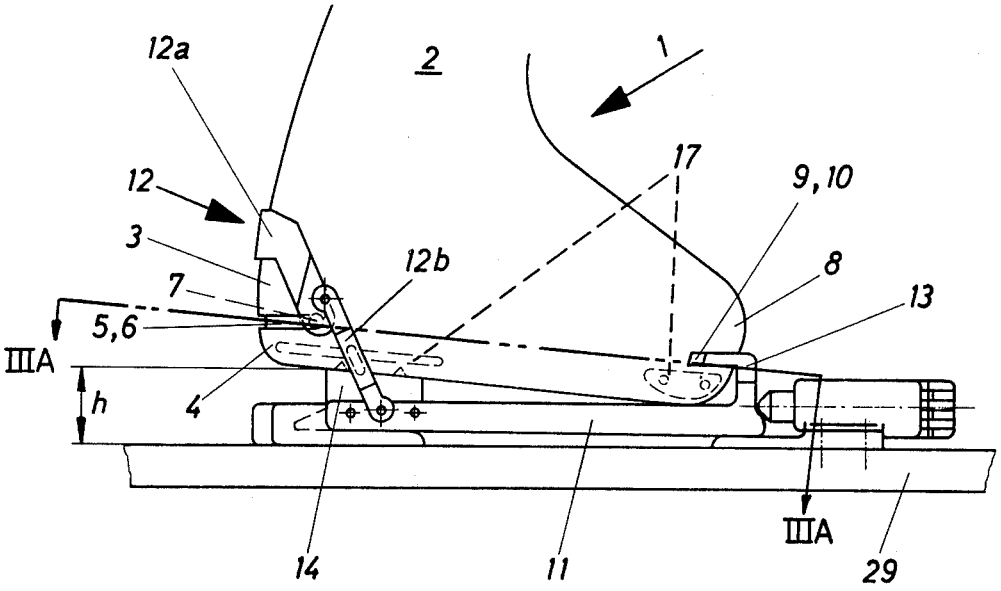
FIG. 1 illustrates in a side view of a first example of the inventive safety ski binding, wherein the mountings according to FIGS. 1 and 2 are known constructions and in which the ski boots are held in so-called plate bindings.

FIG. 1 illustrates a plate binding with conventional receiving means for the plate and a spring mounting, wherein the ski boot is held on the plate by means of the holding elements of the invention and the ski boot has, for engagement with the holding elements, receiving means constructed according to the invention.

Even though the structural height of the binding is considerable, the skier is not positioned any higher than in a ski-boot-binding combination which is commonly available today. This is because the boot has only a thin sole, so that the height *h* corresponds approximately to a common, wedge-reinforced sole height *h'*, as is used according to FIG. 2 in the ski boot construction today.

In order to hold a thin-soled boot on a binding, other measures are needed than in the usual standard designed ski boots which have sole projections and reinforcements. Primarily, the bending and twisting capability of the sole must be resisted in order to assure an effective ski guide.

The torsional deformation of the sole, which is of importance during sideward leaning, can only be resisted by the sole holders or holding elements — as shown in FIG. 3 — which engage at least the receptacle itself, independently of whether the places for the fastenings, or lower portions of the foot, are reinforced for this.

Also it is of no importance for the fastening whether the binding in a conventional manner leans forwardly, whether the stepping-in mechanism is activated by means of a pole opening or whether the adjustment occurs at the toe of the foot or the heel. Projections, recesses, metal fittings and the like may, if desired, be provided on the sides of the receptacle.

It is only important that the holding zones, as shown in FIG. 3A, must be positioned no more than one-third of the radius (rf) of the heel surface of the ski boot beginning and extending rearwardly from points on the sides of the ski boot where a plane P1 perpendicular to the longitudinally central plane P2 of the ski boot and containing the center point CP of the radius intersects the side walls of the ski boot in order to permit the clamping of the sole within the cup onto a stiff base plate. FIG. 3A is a diagrammatic section taken approximately at the line IIIA—IIIA of FIG. 1.

The user of such a boot binding unit obtains several advantages:

As can be recognized from FIG. 3, the upper support surface of the release plate 11' is inclined forwardly 3°–6° from the heel down toward the toe and the binding form permits the wedge pattern in the boot to be in the common zone of 3°–6°. This, and due to the flat sole on the ski boot, permits a straightening of the knee during walking and also a stiff ski boot will be more readily usable during standing and walking.

An elevating adjustment is provided to lift the end of the front plate in order to permit this condition also during travel on a tow lift. This minimizes the danger of opening of the buckles on the instep during a fall from the lift, which opening increases the risk of breaks.

A further advantage according to the embodiment of FIG. 4 lies in the better walking capability of the boot, which is created by omitting the heel extensions, since in this manner the soles become shorter.

This construction minimizes the danger of injury due to a fall because the moments created by the length of the sole are reduced.

The present short form of the boot can be constructed in an extremely slip-resistant manner by profiling and providing suitable edges — because it is entirely or partially flexible, which permits an optimum adaptation to the base plate.

FIGS. 4 and 4*a* show a profile designed for thin-stressed construction, which profile extends in the line of force exerted by the buckle fasteners. Thus it is possible to achieve with a light construction a strong transverse reinforcement without affecting the flexibility of the sole. Further, there is no danger of inwardly deforming the receptacle for the foot when the buckle is closed too tightly.

The design in the heel section shows both the holding element which is formed of a transversely extending profile and also the extension of same to form a transverse reinforcement for the ankle cuff, through a flexible joint.

Figure 5:
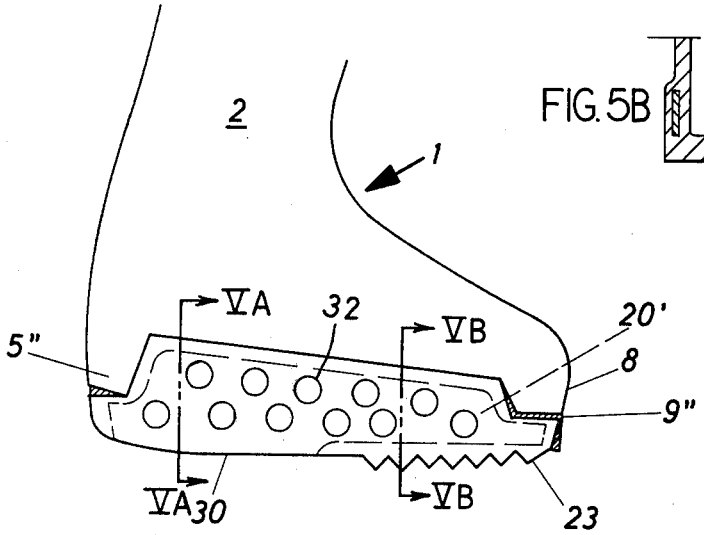
FIG. 5 is a side view of details of the mounting of the ski boot.
Figure 5:
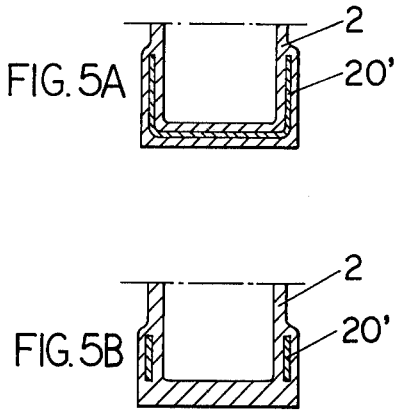

FIG. 5 illustrates, omitting the front sole section and designed profile reinforcement in the holding zones, the partial reinforcement of the receptacle for the foot by means of an internal U-trough molded into the boot.

Figure 6:
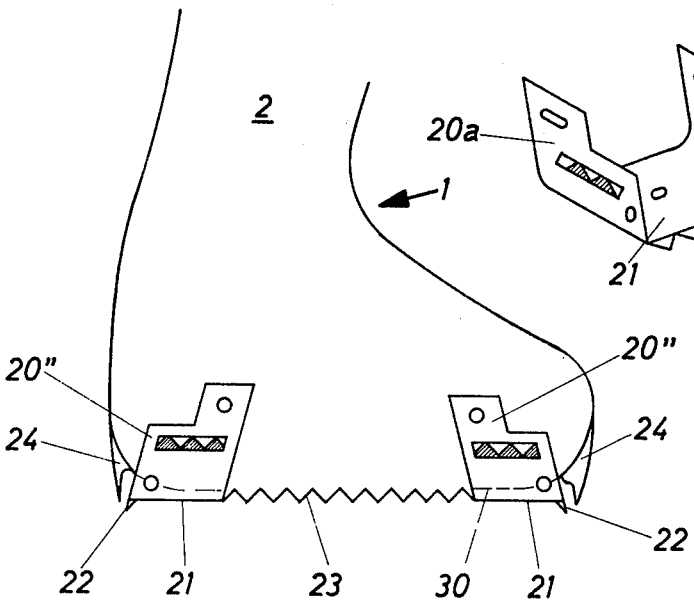
FIGS. 6 and 6*a* illustrate further reinforcing elements for receiving the holding parts of the safety ski binding.
Figure 6A:
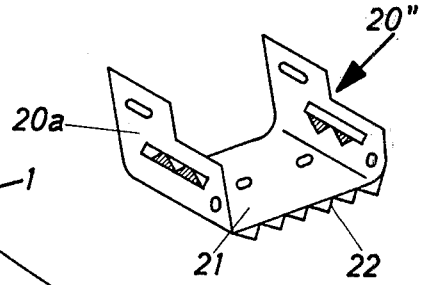

FIG. 6 illustrates two U-shaped transverse reinforcements with outside metal fittings on the flexible boot, which can be mounted for example with counterplates or inserts (not shown), without disturbing the profile during walking. It is, however, still possible in such profiles that same may be on the side or in front to provide profiled locations. This creates an additional security which the ski boots of today do not have, namely protection against slipping on ice. To prevent possible damage during normal use, they are covered inventively for example by a walking sole or flaps which can be clamped or clipped into and over the profiles. FIG. 6 shows the possibility of providing the claws on a built-in reinforcement.

The parts used in the drawings will now be explained. Corresponding parts which fulfill similar functions and are constructed differently are identified by the same reference numeral but with the prime suffix added thereto to distinguish one from another.

The ski boot which as a whole is identified by reference numeral 1 rests on a release plate binding identified by reference numeral 11. The ski boot 1 has an instep or ankle cuff portion 2, a lower part of the rear boot instep portion 3 to receive the rear holding element 12 and a boot tip 8 to receive the front holding element 13. The rear holding element 12 is positioned with its locking pin 7 in shoulder defining grooves, troughs 6 or the like, which are provided in receiving means 5 of the heel 4. The boot tip 8 is similarly provided with a receiving plate 9 for forming of troughs, grooves 10 or the like. In the present exemplary embodiment the rear holding element is formed of two parts 12*a*, 12*b*, which are connected hingedly with one another. The part 12*a* is U-shaped having a pair of legs and embraces the heel of the ski boot. The part or link 12*b* is hinged to the plate of the ski binding 11 and can be secured to various portions of the plate. This makes it possible, as is already known, to change the position of the holding element 12 relative to the release Plate 11 so that adjustment to various sizes of ski boots is possible without affecting the holding conditions.

A support 14 is provided at the rear part of the plate of the ski binding 11, which extends forwardly at an angle. The angle of inclination is, as already mentioned, 3° to 6°. This assures substantially the same position of the foot as exists today in the case of common ski boots with rigid soles.

An insert 17 comprises a generally troughlike reinforcement and is provided in any convenient manner, as by a pre-formed part 20, sheet metal or rigid plastic, molded into the boot at the forward bottom portion of the boot. An alternate insert reinforcement may be provided by the trough-shaped member 20' which is hereinafter further described in more detail.

Figure 2:
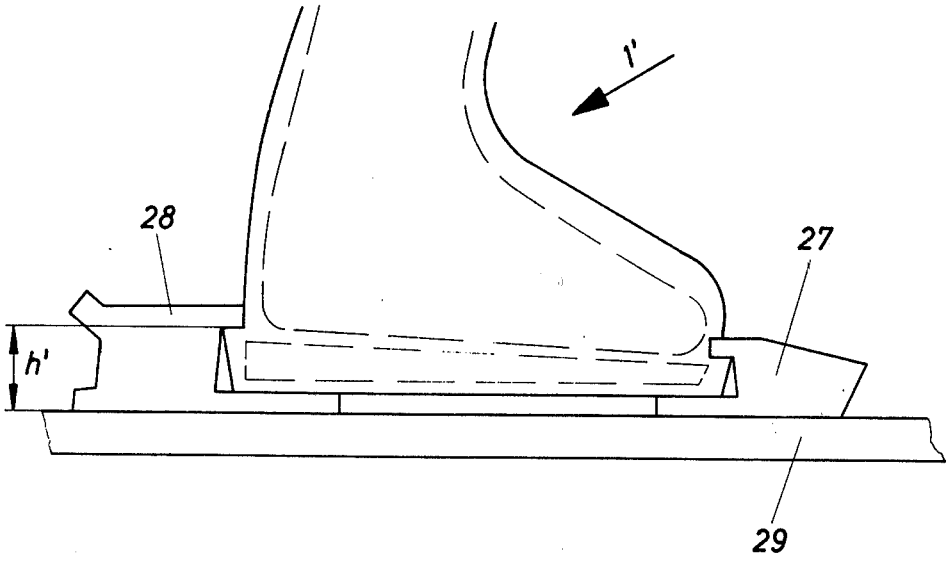
Fig. 2 (PRIOR ART)

FIG. 2 illustrates a presently common ski boot 1' which is held by a front jaw 27 and a rear jaw 28 on the ski 29. FIG. 2 serves solely to demonstrate the elevational position of the heel in the conventional ski boot 1' in relationship to the inventive ski-binding-ski-boot combination according to FIG. 1.

As shown in FIG. 3, the plate 11' of a ski binding is held on the ski 29 by means of front and rear jaws 27' or 28'. Again a rear holding element 12' engages the receiving zone or shoulder 5' of the lower parts of the rear boot instep portion 3 of the ski boot 1 and the tip of the boot 8 is held down by a differently constructed front holding element 13'. The difference between this and the exemplary embodiment according to FIG. 1 lies in the front holding element 13' here permitting stepping out and the rear holding element 12' being constructed as a fixed part. The front holding element 13' has a holding part 13*a* which is secured on the plate of the ski binding 11', on which holding part is pivotally arranged the actual hold-down part 13*b*. The hold-down part 13*b* can be held in locking position as shown in FIG. 3 by a not-illustrated spring. To open at will the front holding element 13', the hold-down part 13*b* has a notch 13*c*, into which force means can be guided indicated by the arrow 15, for example the ski pole. The force means overcomes the holding power of the (not illustrated) spring, after which the hold-down part 13*b* swings in direction of the arrow 15*a* shown with dashed lines and releases the ski boot 1.

FIG. 3 also indicates how the two holding elements 12', 13' are supported on a reinforcing member 20 of the ski boot 1. Further, it is also shown that both the surface of the sole 30 and the surface of the ski binding 11' each have a slip-resistant design 23.

The exemplary embodiment according to FIG. 4 shows the use of special transverse reinforcements 25 of the ski boot 1, wherein these also extend under the sole 30 which results in a particularly good reinforcement and support for the foot without adversely affecting the flexibility of the sole. This considerably improves the skier's walking capability as desired but without diminishing the capacity of the boot to be efficiently gripped to the ski. In the mentioned exemplary embodiment, only the front receiving zone 9 has troughs, grooves or the like 10; the heel 4 is held by means of a transverse reinforcement 25*a*, which has a recess or shoulder 25*b* for the rear holding element (not shown). FIG. 4 shows that the transverse reinforcements 25 fall approximately into the lines of force formed by the buckles 26. The transverse reinforcements 25 extending under the sole 30 are well shown in FIG. 4*a*, wherein here too the buckle 26 is shown more clearly.

FIG. 5 illustrates a support for the bottom of the skier's foot by means of the U-trough 20' which is molded into the boot, the openings 32 providing for flow of plastic material thereinto for effective gripping of such reinforcement member into the boot. The reinforcement member reinforces the bottom of the boot especially in the highly stressed heel area. Thus, it is constructed there as a complete U-profile, but is interrupted in the ball area to provide for good walking capability. In addition, the U-trough 20' forms a support for the receiving zones or shoulders 5'', 9''. The sole 30 has a roughened contour 23 which prevents slippage.

FIG. 6 shows an external reinforcement of the boot 1 by means of two U-shaped reinforcements 20''. The part 21 which projects from the ski boot 1, and the side 20*a* of the U-shaped reinforcements 20'' have claws 22 wherein the front ones are additionally covered with flaps 24 in order to protect same from damage. Here too there is provided a nonskid design 23 of the sole 30.

The invention is not limited to the listed exemplary embodiments. There are a number of possibilities for differently constructing the mountings between ski boot and ski binding, without departing from the scope of the invention. For example the outside metal fittings shown in FIG. 6 can be injected similarly to the example according to FIG. 5 or the reversal thereof.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A combination safety ski binding and ski boot construction, said ski boot having a shell with laterally spaced sides and an arcuate surface at the heel thereof, comprising:

a thin and flexible sole on said ski boot terminating at the forwardmost and rearwardmost extent of a toe and a heel of said shell of said ski boot;

sole rigidifying means on said ski boot to prevent a flexing of said sole at least at the toe and heel thereof;

front and rear holding means mounted on a ski; and front and rear receiving means at said toe and said heel of said ski boot for receiving said front and rear holding means thereon for effecting a securement of said ski boot to said ski, said rear receiving means being an elongate shoulder structure having an effective portion occupying no more than ⅓ of the radius for said arcuate surface beginning and extending rearwardly from points on the sides of said ski boot where a plane perpendicular to the longitudinally central plane of said ski boot and containing the center point for the radius intersects the side walls of said ski boot, said rear holding means including engagement means thereon for engaging said elongate structure only in said ⅓ portion of said receiving means.

2. The combination according to claim 1, wherein said receiving means include one of notches, projections, metal fittings which are mounted directly on the side of the boot instep portion.

3. The combination according to claim 1, wherein said sole rigidifying means includes at least one insert member for reinforcing said rear receiving means.

4. The combination according to claim 3, wherein said insert member is formed by a troughlike reinforcement which is molded into the bottom of said ski boot.

5. The combination according to claim 3, wherein said insert member has a front part which projects frontwardly and downwardly from said ski boot and is constructed as a claw.

6. The combination according to claim 5, wherein said ski boot has a protective flap for covering said claw constructed front part of said insert member adjacent the upper side thereof.

7. The combination according to claim 1, wherein said sole rigidifying means includes transverse reinforcements on said ski boot extending over the sides of said ski boot, at least one of said transverse reinforcements having said receiving means thereon.

8. The combination according to claim 7, wherein said transverse reinforcements extend under parts of the sole and thus serves as an anti-skid means on the sole of said ski boot.

9. A combination safety ski binding and ski boot construction, said ski boot having a shell with laterally spaced sides and an arcuate surface at the heel thereof, comprising:

a sole on said ski boot terminating at the forwardmost and rearwardmost extent of a toe and said heel of a shell of said ski boot;

a release plate;

a reinforcing member in said ski boot sole located adjacent the lower portion of the heel of said ski boot;

front and rear holding means mounted on a ski for holding said release plate on said ski;

front and rear securement means mounted on said release plate;

front and rear receiving means mounted on said ski boot for receiving said front and rear securement means and effecting a securement of said ski boot to said release plate, said rear receiving means at the heel of said ski boot including means defining a recess for receiving said rear securement means therein, said rear securement means including two members hingedly connected together and including adjustable fastening means for connecting said two members to said release plate whereby the position of use of said rear securement means can be varied, said rear securement means including axially aligned pins received in a predefined zone in said recess means, said zone being located on opposite sides of the ski boot adjacent the heel thereof and being dimensioned in a direction parallel to the longitudinal axis of said ski boot an amount no more than ⅓ of the radius for said arcuate surface beginning and extending rearwardly from points on the sides of said ski boot where a plane perpendicular to the longitudinally central plane of said ski boot and containing the center point for the radius intersects the side walls of said ski boot.

10. The combination according to claim 9, wherein the bottom surface of said sole of said ski boot has contoured anti-skid means thereon and wherein said release plate has a surface thereon with a contour matingly corresponding to said contoured anti-skid means.

11. The combination according to claim 9, wherein one of said two members is generally U-shaped having a pair of legs snugly embracing the heel of said ski boot and a bight portion, the other member of said two members including a pair of links each pivotally connected to a leg of said U-shaped part at one end thereof and to said release plate at the other end thereof, said locking pins being mounted on the free ends of said U-shaped part, said pivot connection between said links and said U-shaped part being located between said locking pins and said bight portion; and wherein said release plate includes an elevated support member thereon on which said heel of said ski boot is supported when said locking pins are received in said first recess means.

12. The combination according to claim 9, wherein said release plate has a support surface for supporting said ski boot and is formed with a forward and downward inclination of approximately 3° to 6°.

13. A combination safety ski binding and ski boot construction having release plate means mounted on said ski boot and releasable front and rear holding elements for releasably holding said release plate means on said ski boot, said ski boot having an arcuate surface at the heel thereof, and a bendable sole, comprising the improvement wherein said release plate means has a rear holding member and said ski boot has means defining recesses therein for receiving the holding member therein, said holding member having gripping means for gripping the arcuate heel of the boot and being received only in a predefined zone in said recess means, said zone being located on opposite sides of the ski boot adjacent the heel thereof and being dimensioned in a direction parallel to the longitudinal axis of said ski boot an amount no more than ⅓ of the radius for said arcuate surface beginning and extending rearwardly from points on the sides of said ski boot where a plane perpendicular to the longitudinally central plane of said ski boot and containing the center point for the radius intersects the side walls of said ski boot.

* * * * *